United States Patent [19]

Grantz et al.

[11] Patent Number: 4,691,949

[45] Date of Patent: Sep. 8, 1987

[54] LOCK ARRANGEMENT FOR A MOTOR VEHICLE DOOR

[75] Inventors: Helmut Grantz; Wolfgang Odebrecht, both of Sindelfingen, Fed. Rep. of Germany

[73] Assignee: Daimler-Benz Aktiengesellschaft, Fed. Rep. of Germany

[21] Appl. No.: 835,281

[22] Filed: Mar. 3, 1986

[30] Foreign Application Priority Data

Mar. 2, 1985 [DE] Fed. Rep. of Germany ..... 3507405

[51] Int. Cl.[4] ..... E05C 3/26

[52] U.S. Cl. ..... 292/216; 292/DIG. 26; 292/DIG. 49

[58] Field of Search ..... 292/216, 280, DIG. 26, 292/DIG. 49

[56] References Cited

U.S. PATENT DOCUMENTS 4,487,441 12/1984 Miyamoto et al. ..... 292/216 X
4,505,500 3/1985 Utsumi et al. ..... 292/DIG. 26 X
4,518,180 5/1985 Kleefeldt et al. ..... 292/216 X

FOREIGN PATENT DOCUMENTS 1867301 2/1963 Fed. Rep. of Germany .

*Primary Examiner*—Richard E. Moore

[57] ABSTRACT

A locking arrangement for a motor vehicle door in which a lock housing with a rotary catch acting on a locking bolt on the side of the body, a spring-loaded locking latch, a knee lever arrangement engaging at the rotary catch and at the housing which is formed by two lever members connected in a dead-center joint, and an actuating mechanism is provided, whereby two end positions of the dead-center joint which are coordinated to the locking, respectively, the open position of the rotary catch, are determined by control abutments, and whereby a torque is to be introduced into the rotary catch by means of the actuating mechanism by way of the knee lever, by means of which the door is adapted to be transferred into the locked position against the force of an elastically deformed door seal. This lock arrangement is characterized in that the closing force is to be introduced manually into the actuating mechanism by a door handle at which a return device is effective.

21 Claims, 5 Drawing Figures

LOCK ARRANGEMENT FOR A MOTOR VEHICLE DOOR

The present invention relates to a lock arrangement for a motor vehicle door in which a lock housing is provided that includes a rotary catch acting on a locking bolt on the body, a spring-loaded locking latch, a knee lever arrangement engaging at the rotary catch and at the housing which is formed by two lever members connected in a dead-center joint and an actuating mechanism.

Such a lock arrangement is described already, for example, in the DE-OS No. 31 50 620 or in the DE-OS No. 31 50 621. The so-called "knee lever effect" is already used there in order to overcome with an essentially constant actuating force the deformation forces of the door seal acting opposite during the closing operation of a motor vehicle door which forces behave progressively. The knee lever arrangement is thereby displaced into its end position by means of a sliding pin drive actuated by an electric motor and thereby closes, respectively, opens the lock mechanism. Thus, the functioning ability of the lock arrangement depends on the readiness and availability of an auxiliary force. Therebeyond, a sliding operation takes place by reason of the movement course between the control abutments and the dead-center joint which may lead, on the one hand, to a larger actuating force and, on the other, to a considerable noise annoyance.

Furthermore, a rear lid lock is disclosed in the DE-GM No. 18 67 301 by means of which a low noise closing of the rear lid is possible on a purely mechanical basis and therewith with corresponding operating reliability. In this case, a fork-shaped rotary catch is driven over a part of its opening, respectively, closing rotary angle by means of a coil spring spring-deflecting from a prestressed position. The prestress of the coil spring, however, has to be built up when pressing together the rear lid up to reaching a dead-center position of a spring connecting rod which is pivotally connected at the fork-shaped rotary catch which takes place by abutment of the fork-shaped rotary catch on a coordinated locking bolt on the side of the body. Since the prestressed force of the coil spring must be so selected that the spring rebound force suffices for safely overcoming of the seal forces on the side of the rear lid and at the same time only a part rotary angle of the fork-shaped rotary catch is available for the stroke of the coil spring, the rear lid can be pressed together only with a considerable force impulse so that the handling during the closing operation of the rear lid is complicated.

Additionally, an opening of the rear lid by a customary lock release in which the rotary catch snaps automatically into a release position corresponding to its spring load after pivoting a locking latch so that the rear lid can be opened with slight force application, is not present in the rear lid locking arrangement of the Gebrauchsmuster. Rather, when pulling up the rear lid, the dead-center position between the fork-shaped rotary catch and the spring-connecting rod has to be overcome again.

The possibility of a low noise closing of the rear lid must therefore be accepted with a considerable loss in actuating comfort.

The present invention is therefore concerned with the task to further develop a lock arrangement of the aforementioned type to the extent that a motor vehicle door can be closed with low noise and great operating reliability whereby the customary automatic lock release is to remain possible and a minimum amount in handling comfort during the closing operation is to remain preserved.

The underlying problems are solved according to the present invention in that the knee lever is adapted to be pivoted by means of a pivotally supported pull handle which is spring-loaded against its deflection direction, from the end position of the dead-center joint which is coordinated to the open position of the rotary latch, into the end position of the dead-center joint, which is coordinated to the locking position of the rotary catch, by pivoting-in the pull handle.

These and other objects, features and advantages of the present invention will become more apparent from the following description when taken in connection with the accompanying drawing which shows, for purposes of illustration only, one embodiment in accordance with the present invention, and wherein.

Figure 1:
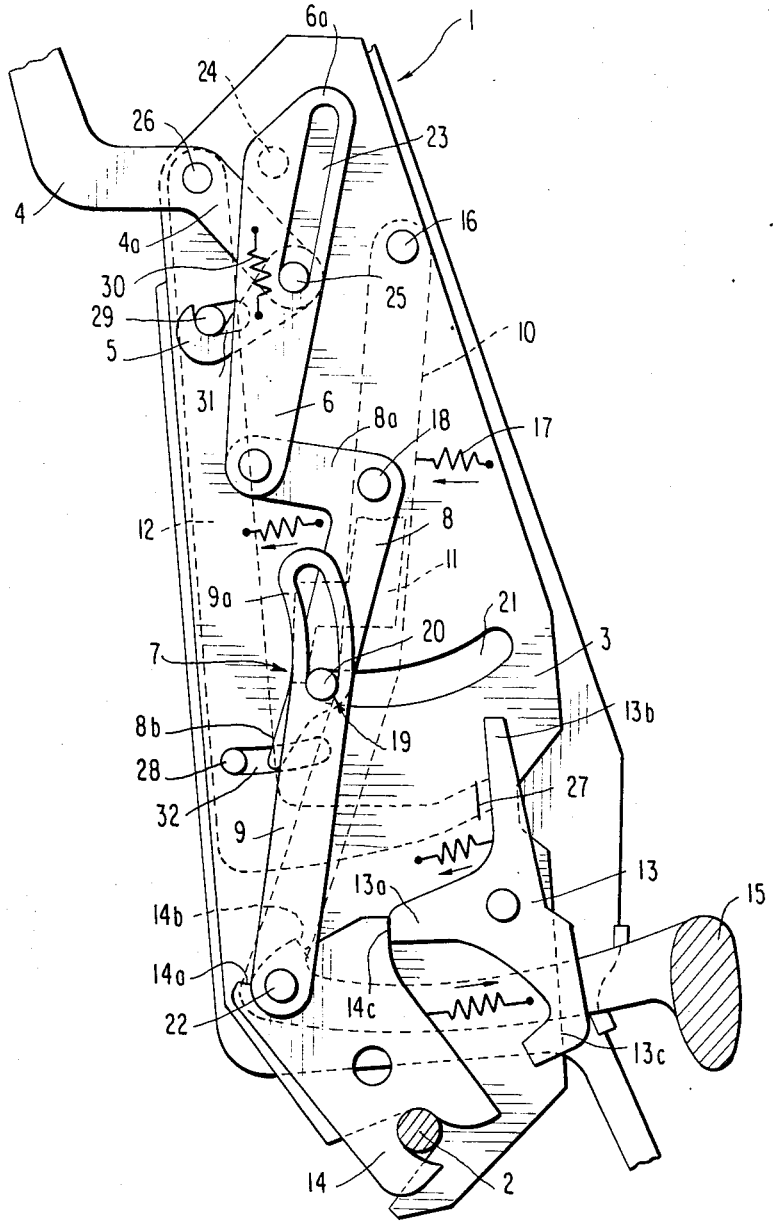
FIG. 1 is a schematic view of a lock arrangement in accordance with the present invention in its closed condition.

Referring now to the drawing wherein like reference numerals are used throughout the various views to designate like parts, a lock arrangement generally designated by reference numeral 1 is integrated in a manner not illustrated in a rear door of a motor vehicle and cooperates for the same as central lock with a bow-shaped locking member 2 secured on the body. As main parts, the lock arrangement 1 includes a lock housing 3, a pivot handle 4 with an outrigger or pivot arm *4a*, an entrainment hook 5, a pull rod 6 with a control lug *6a*, a knee lever generally designated by reference numeral 7 which is formed by two lever members 8 and 9, an angular extension *8a* of the lever member 8, an actuating lever 10, a latch 11, a release arm 12, a locking latch 13, a rotary catch 14 and a pull handle 15. The handle part of the pull handle 15 lies outside of the indicated motor vehicle door so that it can be seized from the outside. The pull handle 15 has a U-shape and is connected with two mutually parallelly extending actuating levers 10 of which only one can be seen. The actuating levers 10 are pivotally supported on the side of the housing on a common bearing shaft 16 and are adapted to be pivoted out by means of the pull handle 15 against the force of a return spring 17 acting in the clockwise direction. The pivot travel of the actuating lever 10 is utilized for the opening and closing operation of the lock arrangement 1. The knee lever 7 is so arranged for that purpose that in its rectilinear position it is located essentially in alignment with the actuating levers 10, and that its pivot range overlaps the deflection area of the knee lever 7. The lever member 8 of the knee lever 7 is rotatably supported about a bearing place 18 on the side of the housing and is coupled to the lever member 9 by way of a dead-center joint generally designated by reference numeral 19. The dead-center joint 19 is defined by a pin 20 positionally secured at the lever member 8, which extends through an elongated aperture guidance 9a of the lever member 9 and through two parallelly extending elongated apertures 21 of two walls of the lock housing 3. The elongated apertures 21 are curved concentrically to the bearing place 18 and are constructed considerably wider than the diameter of the pin 20 so that the pin 20 can deflect without friction in relation to the elongated apertures 21. The deflection angle of the lever member 8 and thus the deflection travel of the dead-center joint 19 is determined by abutment of the pin 20 at the housing walls limiting end-side the elongated aperture 21. An entrainment device for the pin 20 is arranged at the actuating lever 10 which is formed by a latch 11 displaceably supported on the actuating lever 10. The latch 11 adapted to be transferred in dependence on the lock condition, for example, by a lock cylinder or the like, from an operable position in which the latch 11 engages the pin 20 from behind, and in cooperation with a narrow side of the actuating lever 10 is guided parallelly with respect to the same, into an inoperable position in relation to the pin 20 and vice versa. It should be noted in that connection that in the operable position an axial sliding of the pin 20 with respect to the actuating lever 10, respectively, the latch 11, must remain possible in order that the different pivot lengths of the lever member 8 and of the actuating lever 10 can be compensated. The end disposed opposite to the elongated aperture guidance 9a of the lever member 9 is pivotally secured at a bearing place 22 of the rotary catch 14 which, in its turn, is rotatably supported on the side of the housing. The rotary catch 14 is spring-loaded in the clockwise direction and includes blocking abutments 14a, 14b and 14c which in cooperation with a locking member 13a of the locking latch 13 which is also rotatably supported and spring-loaded in the opposite direction, enable three detent positions of the rotary catch 14.

A second actuating mechanism—in this case the door inner actuation—is pivotally connected at the angular extension 8a which thus can influence also the position of the knee lever 7. The pull rod 6 serves as connecting member whose upper area is formed into the control lug 6a by an elongated aperture 23 and by a laterally projecting blocking cam 24. A joint bolt 25 is guided in the elongated aperture 23 which is arranged as connecting joint between the pivot arm 4a and the entrainment hook 5. The pivot arm 4a is constructed in one piece with the pivot handle 4 and thus is pivotal about a pivot bearing 26 by actuation of the pivot handle 4. Therebeyond, one end of the release arm 12 is supported in the pivot bearing 26 whose opposite end is cranked approximately L-shaped and is provided at the free end with a release cam 27. The pivot area of the release arm 12 is so selected that it overlaps that of a release lever 13b of the locking latch 13 so that the latter can be displaced out of its locking position by abutment of the release cam 27 at the release lever 13b. The release arm 12 is provided with an entrainment bolt 28 at the height of an extension 8b of the lever member 8 projecting beyond the dead-center joint 19, whereby the extension 8b is acted upon by the entrainment bolt 28 during deflection of the release arm 12. In order that the release arm 12 can be actuated, it is coupled in the locking condition by the entrainment hook 5 to the pivot movement of the pivot arm 4a. The entrainment hook 5 thereby engages from behind an entrainment pin 29 securely connected with the release arm 12, whereby this operating position is maintained by a drawspring 30 arranged between the entrainment hook 5 and the pivot arm 4a.

The operation of the kinematics of the lock arrangement 1 can be clearly recognized in the different locking positions which will be explained more fully hereinafter:

In the locking condition according to FIG. 1, the fork of the rotary catch 14 completely surrounds the bow-shaped locking member 2 in cooperation with a snap-in opening of the lock housing 3 and is held in this position by abutment of the locking member 13a at the locking abutment 14c. The knee lever 7 is disposed in an inner over dead-center position which corresponds to the inner end position of the pin 20 in the elongated aperture 21 and is positionally stabilized by reason of the fixing of the rotary catch 14. The latch 11 is located in its inner end position so that the pull handle 15 can be pulled out against the prestress force of the return spring 17 without influencing the position of the knee lever 7. An opening of the door is possible from this locking position only by the door inner actuation by means of the pivot handle 4 which, for that purpose, is pivoted in the clockwise direction. Since the entrainment hook 5 engages from behind the entrainment pin 29, the release arm 12 partakes in the pivot movement of the pivot arm 4a whereby the pivot path is determined by the length of an aperture 31 on the side of the housing. During the deflection of the release arm 12, the release cam 27 unlatches the rotary catch 14 in that it pivots the release lever 13b in the clockwise direction. Therebeyond, the entrainment bolt 28 which extends through an aperture 32 on the side of the housing, abuts at the extension 8b and presses the knee lever 7 out of its over dead-center position until the acting spring forces especially the return forces of the door seal are in a position to transfer the knee lever 7 automatically into the outer over dead-center position. The actuating lever 10 and therewith also the pull handle 15 are thereby taken along by the pins 20 up to the opening position.

Figure 2:
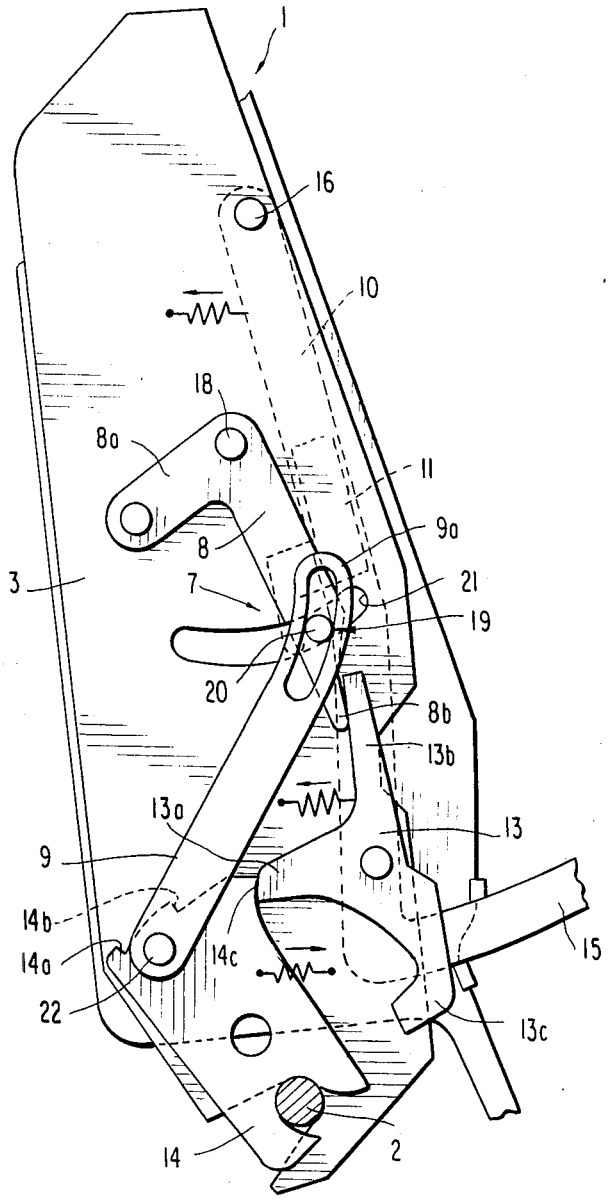
FIG. 2 is a schematic view of the lock arrangement according to FIG. 1 in a first opening phase.
Figure 3:
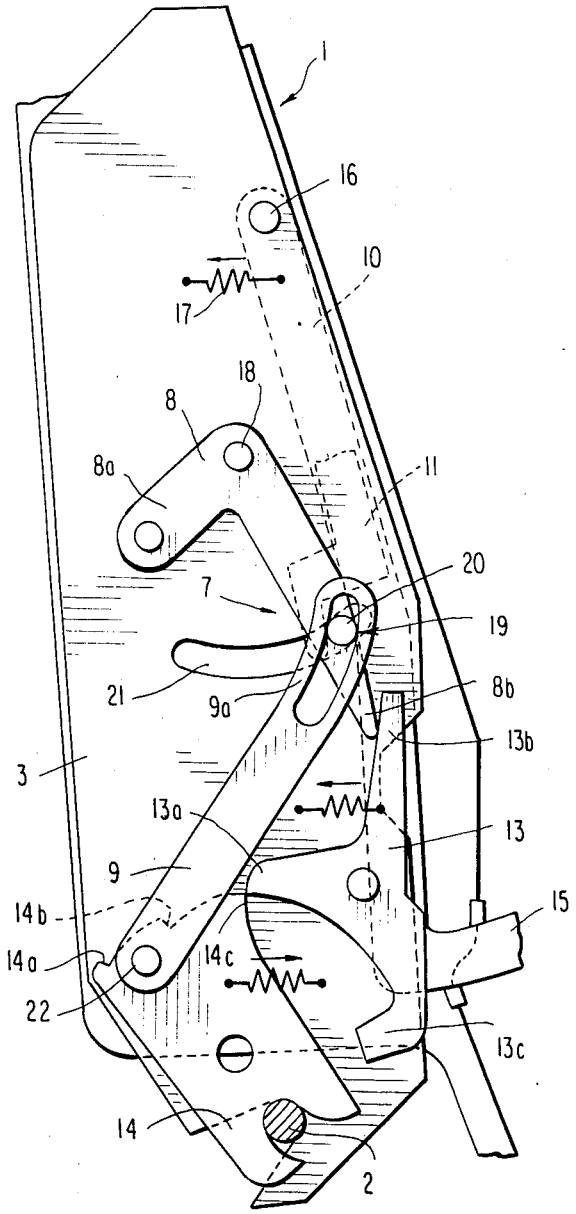
FIG. 3 is a schematic view of the lock arrangement according to FIG. 1 in a last opening phase.
Figure 4:
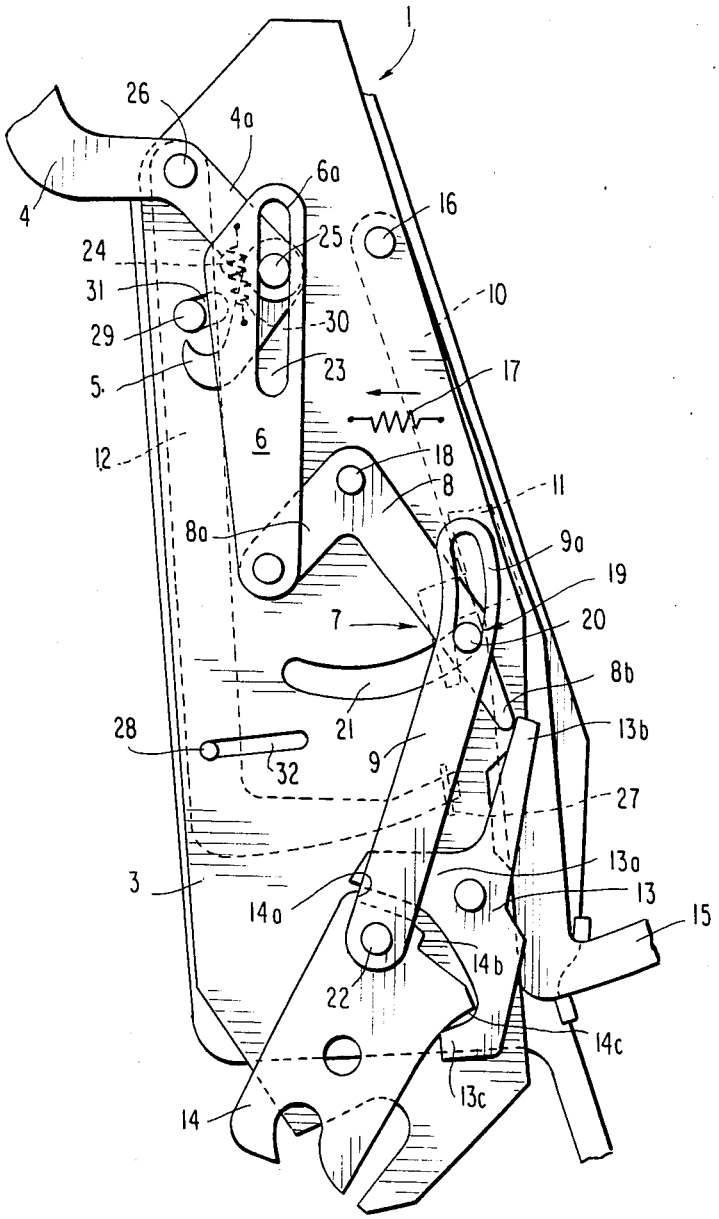
FIG. 4 is a schematic view of the lock arrangement according to FIG. 1 in the open condition.
Figure 5:
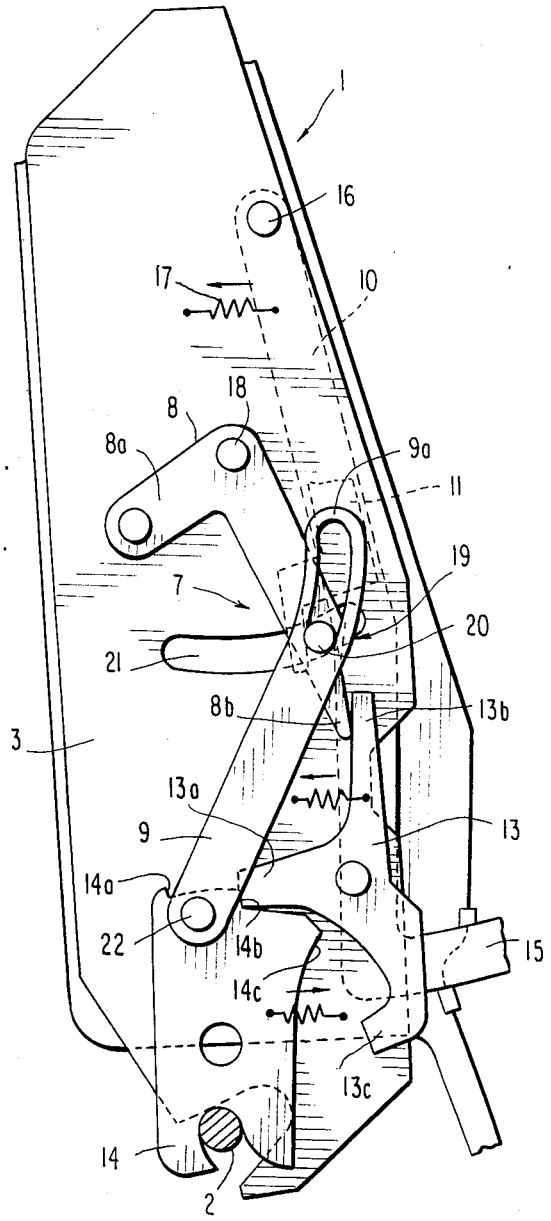
FIG. 5 is a schematic view of the lock arrangement according to FIG. 1 in a pre-detent position.

FIG. 2 illustrates the lock arrangement 1 in a first opening phase initiated by the external actuation. For reasons of simplicity, an illustration of the members serving for the inner actuation is dispensed with in this view. The latch 11 is disposed in a position engaging from behind the pin 20 so that the knee lever 7 has partaken in the pull-out movement of the pull handle 15, respectively, pivot movement of the actuating lever 10. The rotary catch 14 is still disposed in the locking condition and is blocked by the blocking member 13a of the blocking latch 13. The length compensation of the lever member 9 takes place thereby by an elongated aperture guidance 9a so that the deflection of the knee lever 7 is possible notwithstanding the blocked rotary catch 14. The extension 8b abuts at the release lever 13b of the locking latch 13 and leads during the further pulling out of the pull handle 15, as can be seen in conjunction with FIG. 3, to a rotation of the locking latch 13 in the clockwise direction. In FIG. 3, the locking member 13 is disposed directly prior to the release and leads during a further rotation of the locking latch 13 to a snapping-back of the rotary catch 14 in the spring-load direction, in which also the return forces of the door seals are effective so that the open position according to FIG. 4 is assumed. The rotary catch 14 is thereby held in its snap-in position either by abutment of the blocking abutment 14a at the blocking member 13a or, as illustrated, with a fully pulled-out pull handle 15 by a catch hook 13c. The knee lever 7 is in an outer over dead-center position which is positionally stabilized by the stopped rotary catch 14 and positions the pull handle against the return force of the return spring 17 in pulled-out position ready for use. The pull rod 6 is in a position displaced in the direction of the rotary catch 14 corresponding to the deflection of the angular extension 8*a*. A relative displacement between the joint bolt 25 and the elongated aperture 23 has occurred thereby when passing from the locked to the open position, which has led to the fact that the entrainment hook 5 is pivoted by abutment of the blocking cam 24 in the clockwise direction against the stress of the drawspring 30 and thus no longer engages from behind the entrainment pin 29. If the lock arrangement 1 is to be transferred from the open into the locked condition by means of the pivot handle 4, then the pivot handle 4 has to be moved in the counterclockwise direction. The joint bolt 25 thereby slides into its upper end position in the elongated aperture 23 whereby the entrainment hook 5 is further deflected by the blocking cam 24. By the further pivoting of the pivot handle 4 a torque is introduced into the knee lever 7 by way of the pull rod 6 which enables the closing operation with the use of the knee lever effect. During the closing operation, a pre-detent position may also be provided as can be seen from FIG. 5. In the pre-detent position, the bow-shaped locking member 2 is partly surrounded by the rotary catch 14 so that the lock arrangement 1 can be further closed as also again opened. This locked position is characterized in that no sealing forces have to be overcome as yet in order that this closing position can be assumed.

It can be achieved therefore by slight pressure of the coordinated door against the bow-shaped locking member 2 whereby the rotary catch 14 is rotated into the pre-detent position and the locking member 13*a* automatically detents with the blocking abutment 14*b*. For reopening, what was said in connection with FIG. 3 applies analogous. For the complete closing, the pull handle 15 is pushed in. The actuating levers 10 thereby act upon the pins 20 so that the pins 20 reach their inner end position in the elongated aperture 21 which corresponds to its stabilized over dead-center position according to FIG. 1. In the course of the pivot movement of the lever member 8 which occurs thereby, a considerable torque is introduced into the rotary catch 14 by way of the lever member 9 which reaches its maximum value in the dead-center position (aligned position) of the knee lever 7. The torque at the rotary catch 14 increases by the knee lever action equivalent to the progressive characteristics of the deformed door seal so that the actuating forces to be applied remain essentially constant.

The embodiment demonstrates that a low noise door closing is possible by a purely mechanical lock arrangement. If for comfort reasons a servo-actuation is to take place, then for reasons of the higher operating reliability, the latter should be coupled preferably to a purely mechanically functioning lock arrangement as explained.

While we have shown and described only one embodiment in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

We claim:

1. A lock arrangement for a motor vehicle door, comprising lock housing means including rotary catch means rotatable to an open and locked position and acting on a locking bolt on a side of a vehicle body, a spring-loaded locking latch means holding the rotary catch means in a locked position, a knee lever means engaging at the catch means and at the housing means which is formed by two lever members connected in a deflectable dead-center joint means, and actuating means, two end positions of the dead-center joint means are coordinated to the locked and open position of the rotary catch means are determined by control abutment means limiting the deflection of the dead-center joint means, a torque being introduced into the rotary catch means by means of the actuating means moving the knee lever means to deflect the dead-center joint means, by means of which the door is adapted to be transferred into the locked position against the force of an elastically deformable door seal, the knee lever means being displaceable by means of a pivotally supported pull handle, which is spring-loaded against an outward pivoting direction to deflect the dead-center joint means, from the end position of the dead-center joint means which is coordinated to the open position of the catch means, into the end position of the dead-center joint means which is coordinated to the locked position of the rotary catch means by pivoting-in the pull handle.

2. Lock arrangement according to claim 1, wherein the actuating means includes an actuating lever pivotally supported on the side of the housing and having a bearing shaft located essentially in alignment with the knee lever means in the straight position thereof and wherein the pivot area of the actuating lever substantially overlaps the deflection area of the dead-center joint means, the dead-center joint means being acted upon by an entrainment means arranged at the actuating lever, and the dead-center joint means being operable to be deflected into its end position by a pull handle engaging at the free end of the actuating lever.

3. Lock arrangement according to claim 2, wherein a bearing place of the knee lever member on the side of the housing is located nearer the pivot point of the actuating lever than the dead-center joint means or the bearing place on the side of the rotary catch means, a laterally protruding pin arranged at the dead-center joint means with a protruding end surrounded by the entrainment means of the actuating lever so that the dead-center joint means partakes in the pivot movements of the actuating lever, and the pin being guided in an elongated aperture provided on the side of the housing which extends concentrically to the bearing place of the knee lever means on the side of the housing so that the two end positions of the dead-center joint means are determined by abutment of the pin at the housing walls delimiting the elongated aperture at the ends thereof.

4. A lock arrangement according to claim 3, wherein the entrainment means of the actuating lever includes a latch displaceably supported in the actuating lever longitudinal direction, which engages the pin from behind and is parallelly guided in cooperation with a narrow side of the actuating lever.

5. A lock arrangement according to claim 4, wherein the latch is operable to be transferred from its operative position engaging the pin from behind into an inoperative position in relation to the pin.

6. A lock arrangement according to claim 5, wherein the pin protrudes on both sides of the dead-center joint means and extends on both sides thereof through an elongated aperture means in each of two parallel walls of the housing means and two parallelly extending actuating levers being provided on both sides of the housing means which are operatively connected with each other.

7. A lock arrangement according to claim 6, wherein the actuating levers are connected with each other by a U-shaped bow member which forms the pull handle.

8. A lock arrangement according to claim 6, wherein the lever member of the knee lever means supported on the side of the housing is extended beyond the dead-center joint means into a position that overlaps the pivot area of a release lever of the locking latch means.

9. A lock arrangement according to claim 8, wherein the lever member of the knee lever means supported on the side of the rotary catch means is extended beyond the dead-center joint means into an elongated aperture guide means.

10. A lock arrangement according to claim 9, wherein the lever member supported on the side of the housing is constructed as angle lever whereby an angular extension is operatively connected with a second actuating means.

11. A lock arrangement according to claim 10, wherein the second actuating means includes a pivot handle rigidly connected with a pivot arm extending beyond a pivot bearing, a pull rod pivotally arranged between the free end of the pivot arm and the free end of the angular extension, an entrainment hook positioned in dependence on the deflection angle of the pivot arm and the position of the pull rod, and a pivotally supported release arm which cooperates with the release lever of the locking latch means and by means of which the knee lever means is acted upon.

12. A lock arrangement according to claim 11, wherein the positioning of the entrainment hook takes place by a control lug arranged at the pull rod, in which the joint between pivot arm and entrainment hook is longitudinally displaceably guided, by a blocking cam arranged on the side of the control lug, by a prestressed spring stressing the entrainment hook in a clockwise direction and by an entrainment pin protruding from the release arm, whereby the entrainment hook is adapted to be transferred from a detent position in which it engages the entrainment pin from behind in the locking position, into an inoperative rest position in the open position.

13. A lock arrangement according to claim 12, further comprising adjusting drive means for displacing the dead-center joint means into the over dead-center positions corresponding to the open and locked positions.

14. A lock arrangement according to claim 3, wherein the pin protrudes on both sides of the dead-center joint means and extends on both sides thereof through an elongated aperture means in each of two parallel walls of the housing means and two parallelly extending actuating levers being provided on both sides of the housing means which are operatively connected with each other.

15. A lock arrangement according to claim 14, wherein the actuating levers are connected with each other by a U-shaped bow member which forms the pull handle.

16. A lock arrangement according to claim 1, wherein the lever member of the knee lever means supported on the side of the housing is extended beyond the dead-center joint means into a position that overlaps the pivot area of a release lever of the locking latch means.

17. A lock arrangement according to claim 1, wherein the lever member of the knee lever means supported on the side of the rotary catch means is extended beyond the dead-center joint means into an elongated aperture guide means.

18. A lock arrangement according to claim 1, wherein the lever member supported on the side of the housing is constructed as angle lever whereby an angular extension is operatively connected with a second actuating means.

19. A lock arrangement according to claim 18, wherein the second actuating means includes a pivot handle rigidly connected with a pivot arm extending beyond a pivot bearing, a pull rod pivotally arranged between the free end of the pivot arm and the free end of the angular extension, an entrainment hook positioned in dependence on the deflection angle of the pivot arm and the position of the pull rod, and a pivotally supported release arm which cooperates with the release lever of the locking latch means and by means of which the knee lever means is acted upon.

20. A lock arrangement according to claim 19, wherein the positioning of the entrainment hook takes place by a control lug arranged at the pull rod, in which the joint between pivot arm and entrainment hook is longitudinally displaceably guided, by a blocking cam arranged on the side of the control lug, by a prestressed spring stressing the entrainment hook in a clockwise direction and by an entrainment pin protruding from the release arm, whereby the entrainment hook is adapted to be transferred from a detent position in which it engages the entrainment pin from behind in the locking position, into an inoperative rest position in the open position.

21. A lock arrangement according to claim 1, further comprising adjusting drive means for displacing the dead-center joint means into the over dead-center positions corresponding to the open, respectively, locked positions.

* * * * *